US010790602B2

(12) United States Patent
Wright et al.

(10) Patent No.: US 10,790,602 B2
(45) Date of Patent: Sep. 29, 2020

(54) ELECTRICAL CONNECTOR FOR CONNECTING ELECTRICAL CONDUCTORS TO A PRINTED CIRCUIT BOARD

(71) Applicant: Weidmüller Interface GmbH & Co. KG, Detmold (DE)

(72) Inventors: Stephan Wright, Detmold (DE); Sascha Nolte, Bad Driburg (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 16/658,739

(22) Filed: Oct. 21, 2019

(65) Prior Publication Data

US 2020/0127396 A1 Apr. 23, 2020

(30) Foreign Application Priority Data

Oct. 22, 2018 (DE) ..... 10 2018 126 145

(51) Int. Cl.

| | |
|---|---|
| ***H01R 12/70*** | (2011.01) |
| ***H01R 12/71*** | (2011.01) |
| ***H01R 43/26*** | (2006.01) |
| ***H01R 12/51*** | (2011.01) |

(52) U.S. Cl.

CPC ..... *H01R 12/7011* (2013.01); *H01R 12/515* (2013.01); *H01R 12/7082* (2013.01); *H01R 12/714* (2013.01); *H01R 43/26* (2013.01)

(58) Field of Classification Search

CPC ..... H01R 12/7011

See application file for complete search history.

(56) References Cited

U.S. PATENT DOCUMENTS

| | | | | |
|---|---|---|---|---|
| 4,786,225 | A * | 11/1988 | Poe | F16B 5/065 24/297 |
| 5,266,052 | A * | 11/1993 | Phillips, II | F16B 13/126 411/502 |
| 5,496,080 | A * | 3/1996 | Chabanne | B60N 2/01533 292/252 |
| 6,769,932 | B1 * | 8/2004 | Daoud | H01R 12/7011 439/458 |
| 10,264,694 | B1 * | 4/2019 | Lin | H01R 12/7076 |

(Continued)

FOREIGN PATENT DOCUMENTS

| | | | |
|---|---|---|---|
| DE | 102011011017 | A1 | 8/2012 |
| DE | 202009018730 | U1 | 11/2012 |
| DE | 202016105358 | U1 | 1/2018 |

*Primary Examiner* — James Harvey

(74) *Attorney, Agent, or Firm* — Laubscher & Laubscher, P.C.

(57) ABSTRACT

An electrical connector for connecting an electrical conductor to a circuit board includes a housing electrically connected on a connecting side of the electrical connector to an electrical connecting part and including a contact side having one or more contacts, in order to make electrical contact with one or more mating contacts of the circuit board. A locking pin assembly passes through an opening of the circuit board and moves from a release position to a locking position in which its diameter on the side of the opening facing away from the housing is larger than the diameter of the opening of the circuit board. The housing includes at least one activating device and the locking pin assembly includes at least two functional elements which move relative to each other.

22 Claims, 15 Drawing Sheets

(56) References Cited

U.S. PATENT DOCUMENTS

| | | | | |
|---|---|---|---|---|
| 2008/0248678 | A1* | 10/2008 | Tuerschmann | H01R 12/7047 439/345 |
| 2010/0279523 | A1* | 11/2010 | Schwettmann | H01R 12/585 439/81 |
| 2011/0072619 | A1* | 3/2011 | Wang | H04M 1/0216 16/339 |
| 2011/0249419 | A1* | 10/2011 | Sun | H01R 12/732 361/803 |
| 2013/0102187 | A1* | 4/2013 | Camelio | H01R 24/50 439/578 |
| 2017/0288341 | A1* | 10/2017 | Tuenker | H01R 13/518 |

* cited by examiner

FIG. 4a
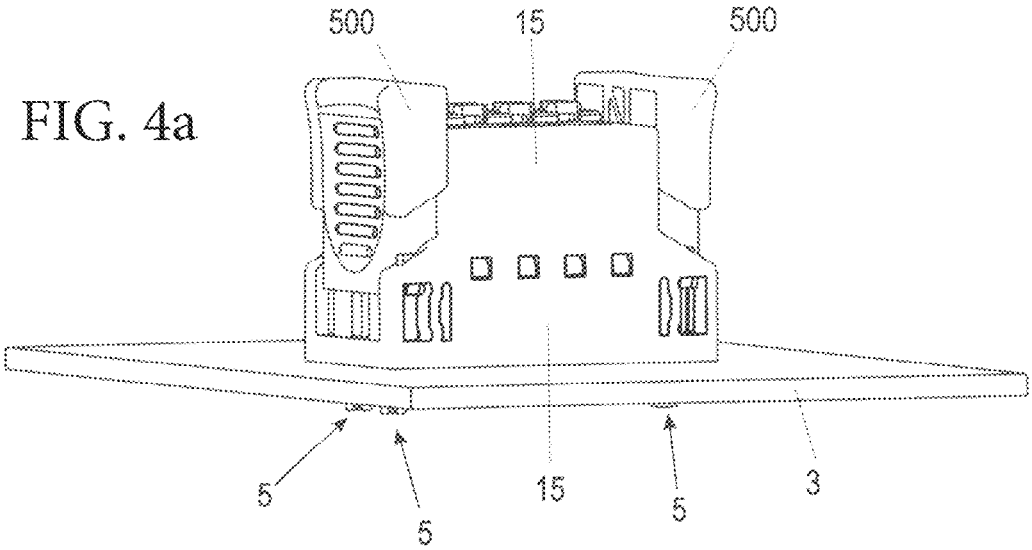
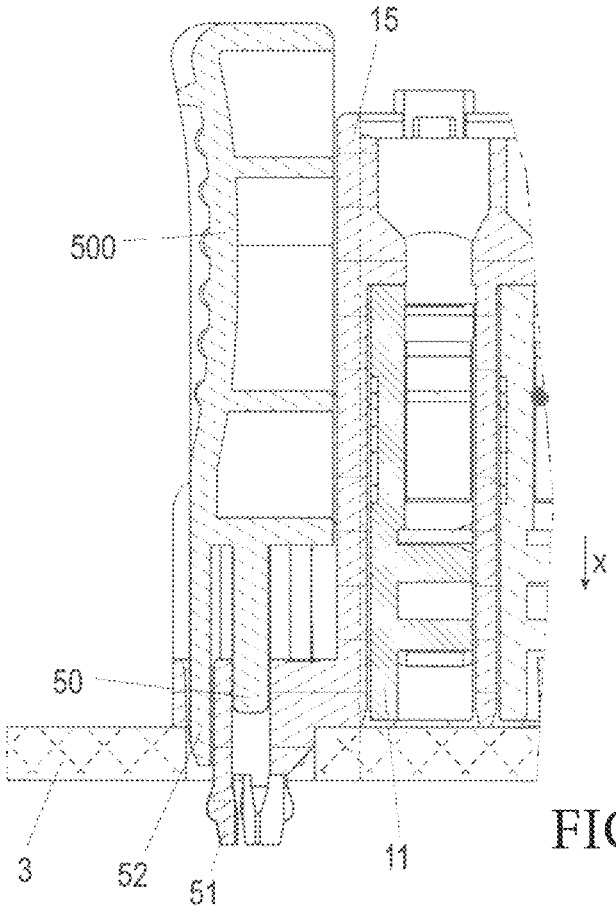
FIG. 4b

FIG. 5a
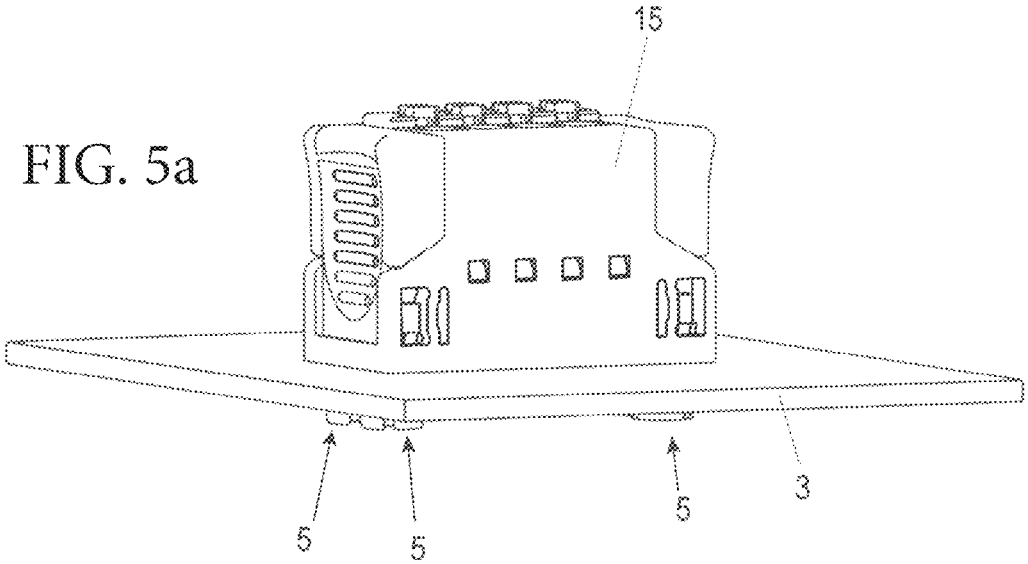
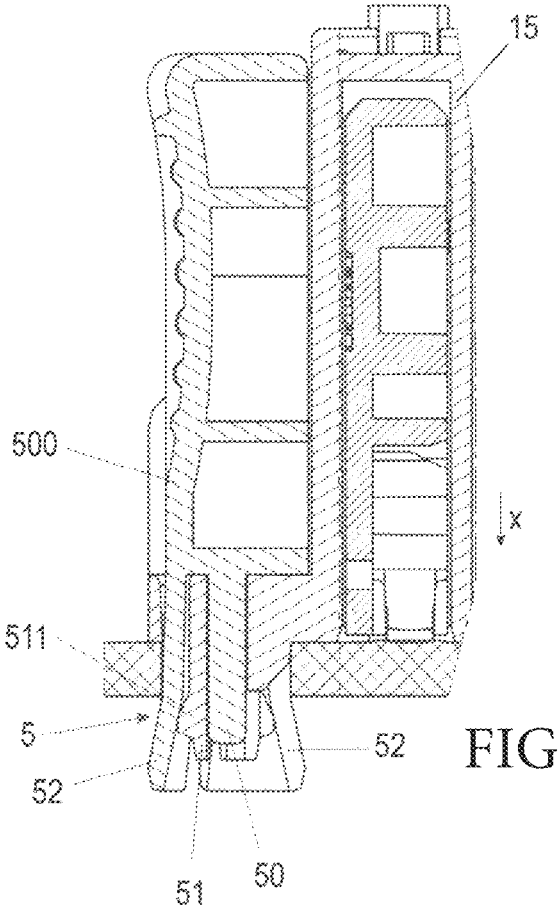
FIG. 5b

FIG. 7a
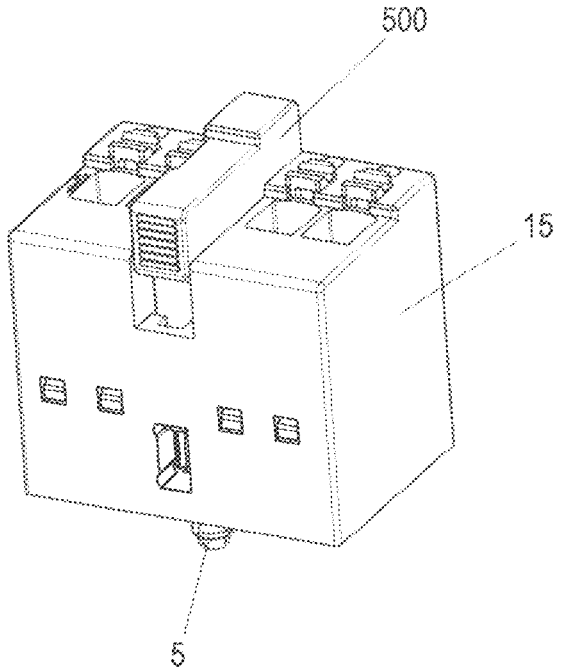
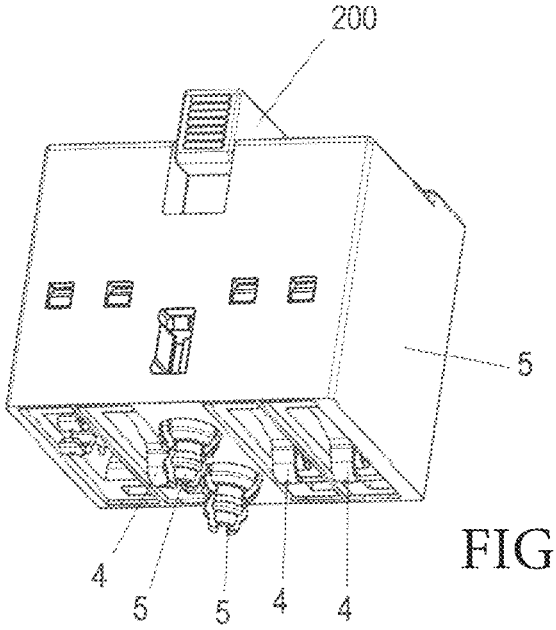
FIG. 7b

FIG. 8a
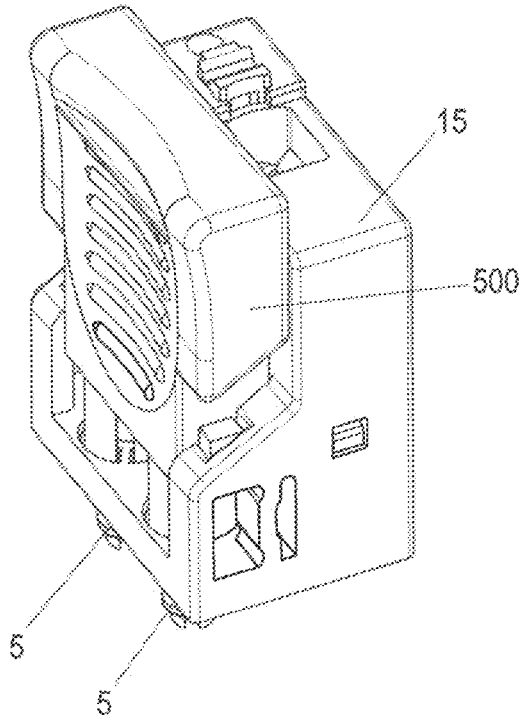
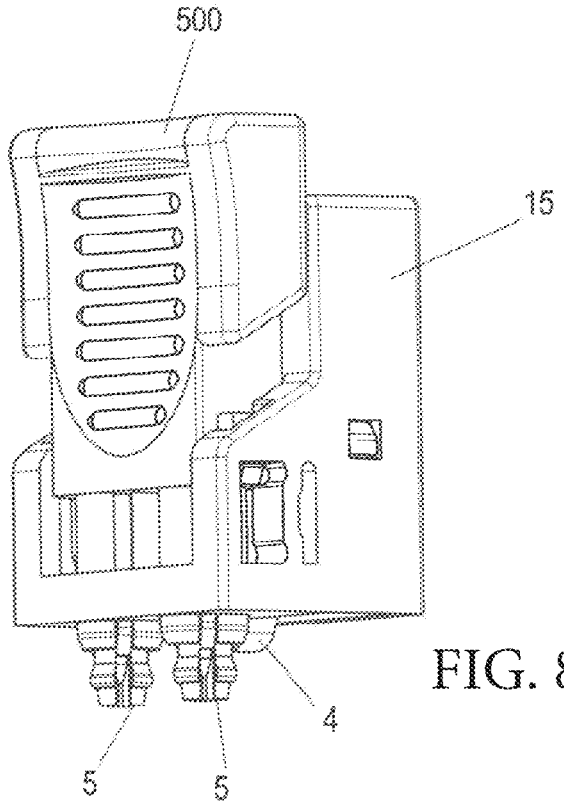
FIG. 8b

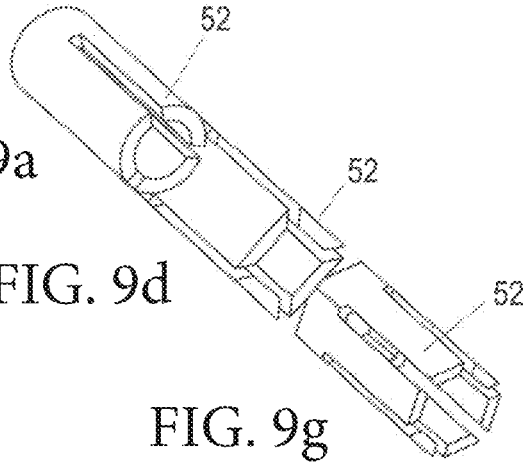
FIG. 9a
FIG. 9d
FIG. 9g
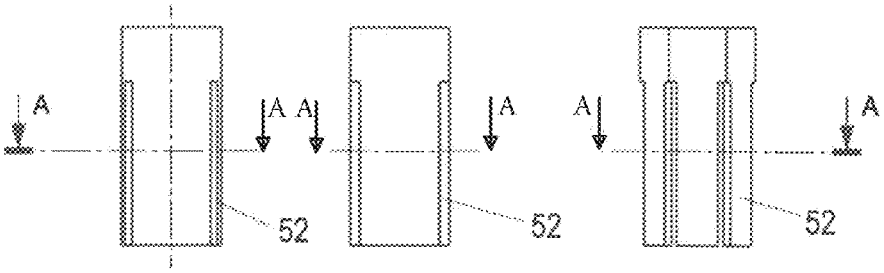
FIG. 9b FIG. 9e FIG. 9h
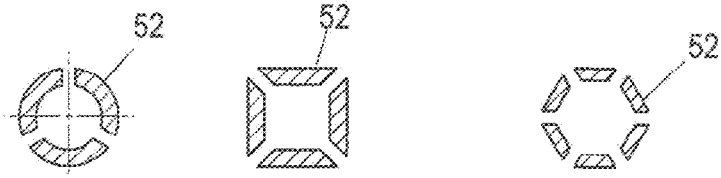
FIG. 9c FIG. 9f FIG. 9i FIG 12a
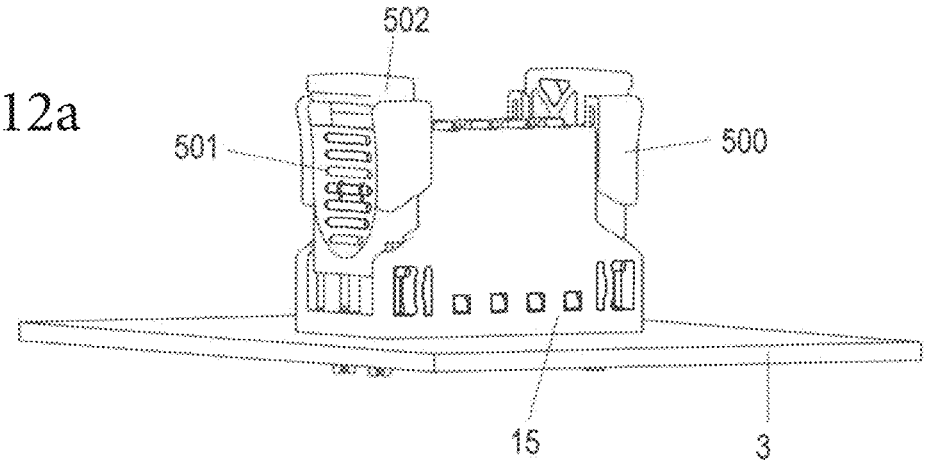
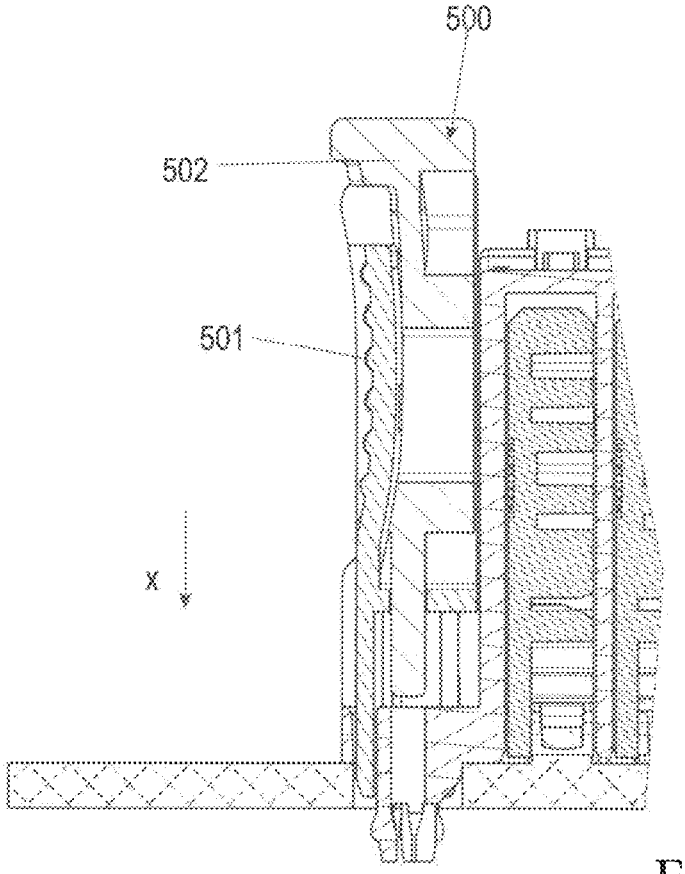
FIG. 12b FIG. 13a
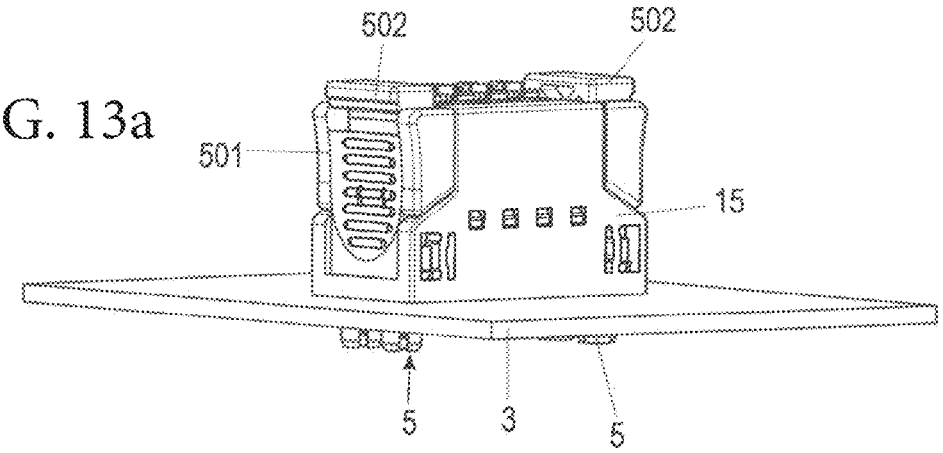
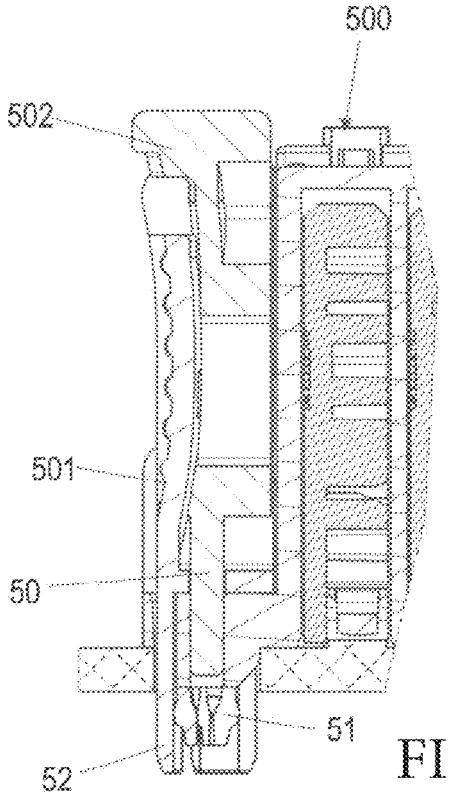
FIG. 13b FIG. 14a
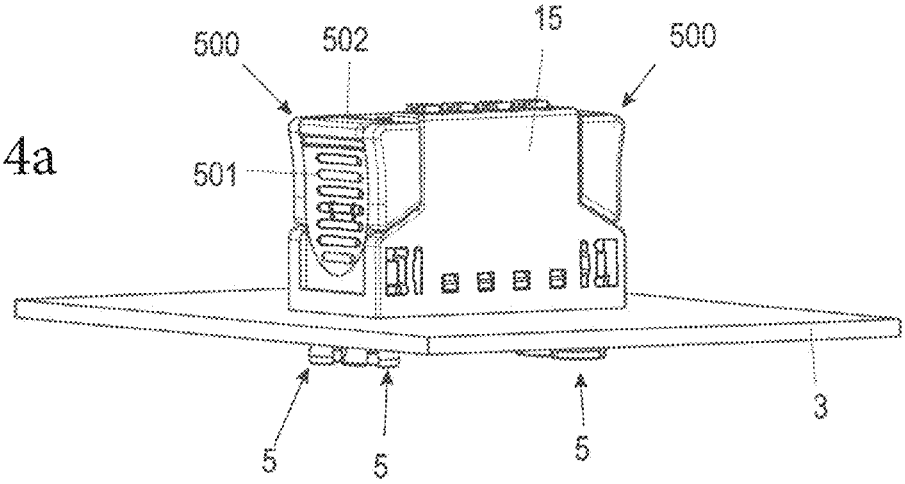
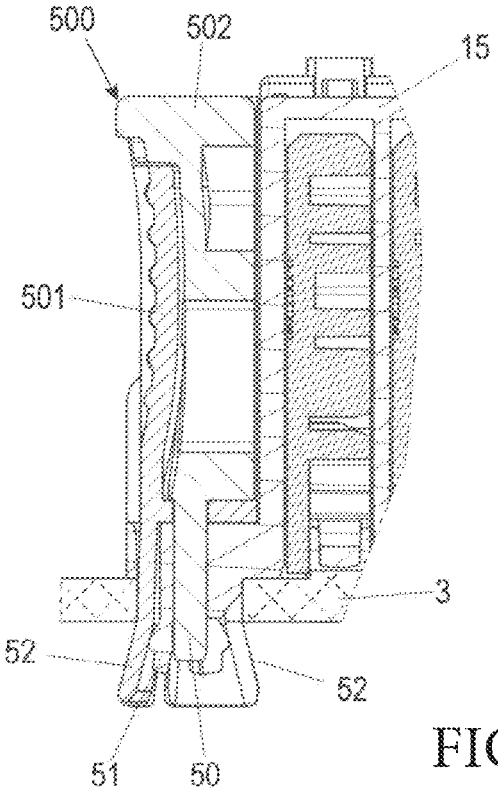
FIG. 14b

ELECTRICAL CONNECTOR FOR CONNECTING ELECTRICAL CONDUCTORS TO A PRINTED CIRCUIT BOARD

This application claims priority of DE 10 2018126145.4 filed Oct. 22, 2018, the entire contents of which are incorporated herein by reference.

BACKGROUND OF THE INVENTION

The present invention relates to an electrical connector for connecting electrical conductors to a circuit board.

The present invention further relates to a method for connecting and securing such an electrical connector to a circuit board.

For connecting one or more electrical conductors or multi-core cables to electrical circuit boards, one uses connection plugs or connectors to which one or more conductors can be attached and which generally include one contact for each conductor for contact with a mating contact of the circuit board. The contacts of the connector plug are arranged in or on a single or multiple-piece housing which can be secured to the circuit board. Thus, fasteners and mating fasteners need to be formed on the housing and on the circuit board, respectively. It is known to provide fasteners in the form of expanding dowels which are movable substantially perpendicular to the circuit board surface and which are designed to pass through a borehole or a through hole of the circuit board as the mating fastening device when the housing is mounted on the circuit board, whereupon the expanding dowels when introduced into these boreholes are at first compressed until they reach a final mounting position, after which they relax or expand so that the housing can be secured on the circuit board.

This type of fastener of the connector on the circuit board has proven to work well. However, there is a need for improvement in regard to the possibility of release of a locking pin and thus the housing and the entire connector from the circuit board. Furthermore, it is desirable to design the entire fastening process—i.e., the locking or fastening and the unlocking or releasing of the connector—such that the connector can be relatively easily locked by hand on the circuit board and also unlocked or released from the locking position once again.

SUMMARY OF THE INVENTION

According to the invention, an electrical connector is provided which is intended for the electrical connection of an electrical connecting part, such as an electrical conductor or plug, to a circuit board. The connector includes a housing, which can be electrically connected on a connecting side of the electrical connector to an electrical connecting part. The housing includes at least one contact on a contact side of the electrical connector to make electrical contact with one or more mating contacts of the circuit board. A locking pin assembly, which when mounted on the circuit board passes through an opening of the circuit board and can move from a retracted release position to an expanded locking position in which its diameter on the side of the opening facing away from the housing is larger than the diameter of the opening of the circuit board, so that it cannot be pulled out from the circuit board from the housing side without being destroyed. The housing includes at least one actuation device which can move relative to the housing. The locking pin assembly includes at least two functional elements able to move relative to each other, at least one of which is arranged on the actuation device and at least one other one is arranged on a component of the connector which is movable relative to the actuation device.

In this way, it is possible to separate contacting and locking from each other and to preferably perform them in succession so that it becomes possible to perform the locking or fastening and the unlocking or releasing of the connector such that the connector can be locked relatively easily and without major effort by hand to the circuit board and also be unlocked or released once again from the locking position. In particular, it is also possible to use the locking assembly repeatedly, so that it can also be released once more from its locking position without problems. The term circuit board encompasses boards of the most diverse kind on which at least one or more contacts, conductor tracks, and electrical and electronic components are formed or arranged.

According to one preferred embodiment, at least one of the functional elements which are movable relative to each other is arranged on the housing as the movable component of the connector relative to the actuation device. Thus, the other of the functional elements can be fastened directly or on a further activator, which is then movable relative to the activation element and to the housing but is also arranged indirectly on the housing.

Preferably, the contacts are designed as compression spring contact or mating contacts—for example formed as metal surfaces, such as solder pads or the like. Such a configuration, especially in combination with the locking pin assembly, provides an especially light but nevertheless secure type of contact and connection of the connector to the circuit board.

One or several actuation devices may be provided on the housing. Moreover, the housing and the respective actuation device each form two or more of the locking pin assemblies. In this case, twofold or multiple locking can be achieved with the actuation of only one of the activation elements.

According to another embodiment, the respective locking pin assembly includes at least one expanding mandrel, one or more expanding wedges arranged radially and concentrically on the outside of the expanding mandrel, and one or more expanding webs arranged radially and concentrically on the outside of the expanding wedges as the functional elements. With these elements, a secure, easily operated and releasable locking of the housing to the circuit board can be achieved. Further, the expanding mandrel and the expanding webs are arranged on the actuation device and the expanding wedges are formed on the housing. In this way, it is possible to design the connector such that the locking webs during the locking process are not plastically deformed to such an extent that release becomes impossible. Instead, it is possible to release the locking assembly again and reuse the connector.

This may be achieved structurally in a variety of ways. Thus, according to a first embodiment, the actuation device has a single piece configuration. In particular, the actuation device may be designed such that the expanding web or webs and the expanding mandrel can move synchronously together.

Alternatively, the actuation device has a multiple piece configuration. Thus, the actuation device may include a first activation section on which the expanding web or webs are formed and a second activation section which is movable relative to the first activation section, on which the expanding mandrel is formed. In this way, the expanding webs and the expanding mandrel can be moved in succession and locking and the unlocking can be performed easily and securely.

In order to obtain the locking position, the expanding wedge or wedges each have a thickened region which in the mounted state of the housing on the circuit board lies on the side of the circuit board facing away from the housing and on which the expanding webs are moved into their expanded locking position during the locking process.

The functional elements of the locking devices can be designed in diverse ways. Thus, the expanding mandrel may have a round, an angular, or a polygonal cross section and one or more of the expanding wedges can be distributed around its circumference on a corresponding imaginary circular or polygonal contour and one or more of the expanding webs can be distributed around the expanding wedges on a corresponding imaginary circular or polygonal contour.

The actuation device is formed as a sliding device and the actuation device and the housing include corresponding guides such as pins and elongated holes which enable displacement of the actuation device on the housing in a locking direction X and in an opposite release direction −X.

According to another embodiment, in a position in which the actuation device is moved into an upper position further removed from the circuit board and the connector is mounted on the circuit board, the expanding wedges pass through the respective opening of the circuit board but the expanding mandrel and the expanding webs have not yet passed through it or not fully through it, and the actuation device is movable from the upper position into a lower position in which the expanding mandrel engages between the expanding wedges as far as the thickened region of the expanding wedges. The expanding webs are moved into an interacting conically widened position which is the locking position.

The locking devices preferably are combined with compression contacts but may also be pin, knife, or socket contacts.

A method for making contact between a circuit board and a connector includes the following steps. The connector is placed on the circuit board and the contacts of the connector make contact with the mating contacts of the circuit board. The expanding wedges of the expanding dowel assembly pass through the opening of the circuit board. At least one activation element is moved into a locking position on the housing by applying a locking force in which the expanding webs are moved into and the expanded locking position on the outside of the expanding wedges which lie on the inside against the expanding mandrel.

The expanding mandrel and the expanding webs are moved synchronously into the locking position. Alternatively, the two activation sections are displaced in succession on the housing and the expanding mandrel and the expanding webs are moved in succession into the locking position.

The connecting and locking direction X of the connector extends perpendicularly to the circuit board.

Such a connector can be quickly attached or retrofit to an electrical circuit board and positioned securely on the circuit board. This ensures durable contact of the connector with contact surfaces of the circuit board.

BRIEF DESCRIPTION OF THE FIGURES

Other objects and advantages of the invention will become apparent from a study of the following description with reference to the accompanying drawing, in which:

FIGS. 4*a* and 4*b* are perspective and front partial sectional views, respectively, of the connector and circuit board prior to operation of the locking assembly;

FIGS. 5*a* and 5*b* are perspective and front partial sectional views, respectively, of the connector and circuit board following operation of the locking assembly;

FIGS. 7*a* and 7*b* are top and bottom perspective views, respectively, of a second embodiment of a connector according to the invention;

FIGS. 8*a* and 8*b* are top and bottom perspective views, respectively of a third embodiment of a connector according to the invention;

FIGS. 9*a*-9*i* are views of various configurations for locking pins, respectively, according to the invention;

FIGS. 12*a* and 12*b* are perspective and front partial sectional views, respectively, of the connector and circuit board prior to operation of the locking assembly;

FIGS. 13*a* and 13*b* are perspective and front partial sectional views, respectively, of the connector and circuit board during operation of the locking assembly; and FIGS. 14*a* and 14*b* are perspective and front partial sectional views, respectively, of the connector and circuit board following operation of the locking assembly.

DETAILED DESCRIPTION

Figure 1A:
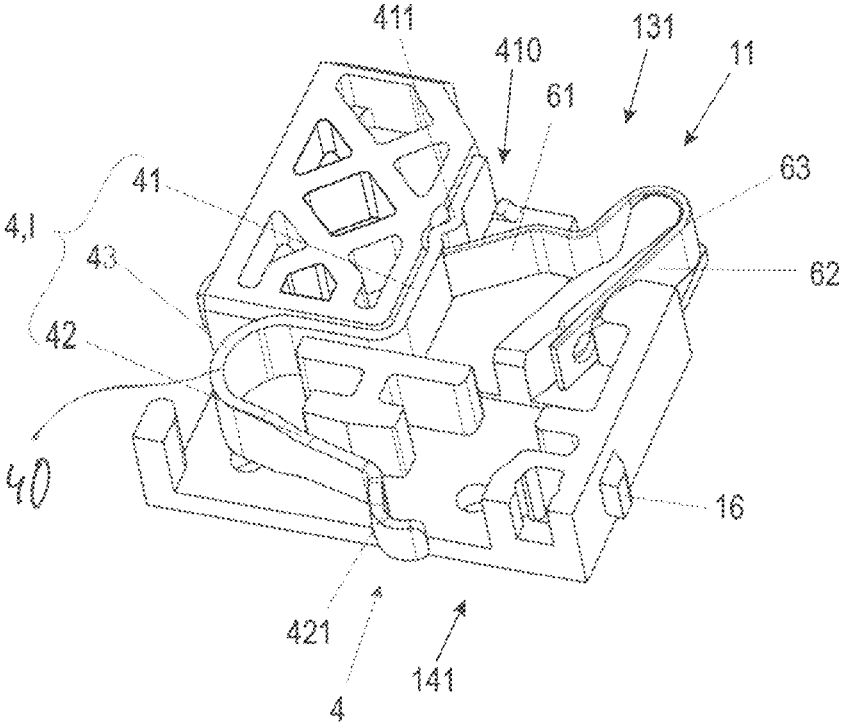
FIGS. 1*a*-1*c* are perspective views, respectively, of a housing of an electrical connector according to the invention.
Figure 1B:
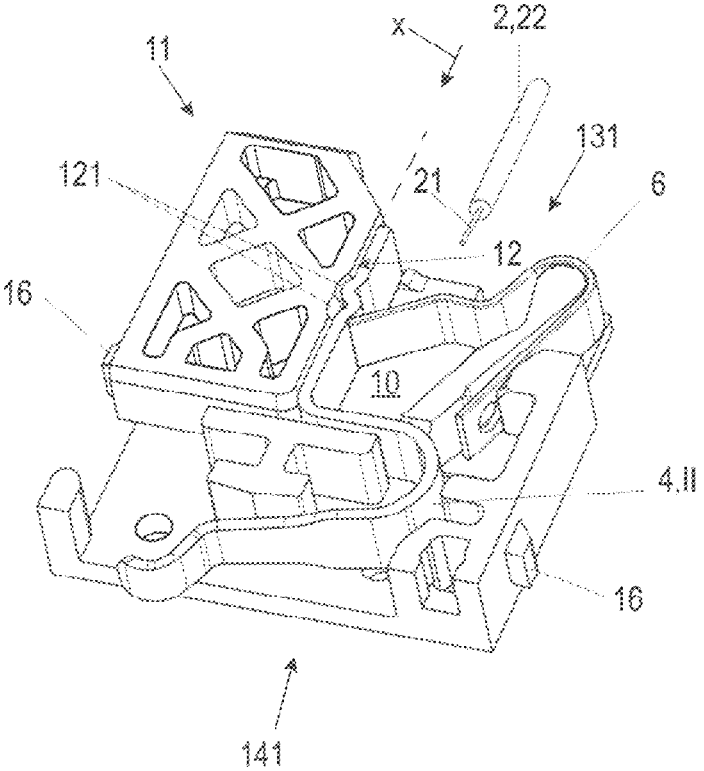
Figure 1C:
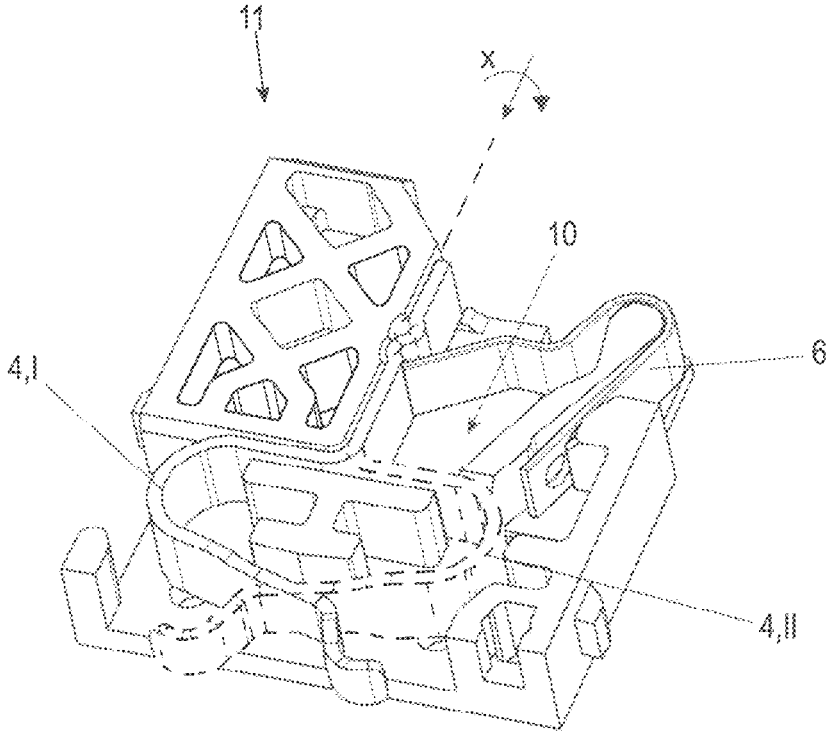

FIGS. 1*a*-1*c* show a housing 11 of an electrical connector 1 according to the invention. In the housing 11 there is arranged a connecting chamber 10. The connecting chamber 10 is designed to receive a conductor connector contact 4 which designed to contact a mating contact, such as a solder surface or the like on a surface of a circuit board 3.

The contact 4 is designed on a busbar 40. This is advantageous, but not necessary in the context of the present invention. The contact 4 instead also be designed in a different manner. It is advantageous for it to be designed as a compression spring contact which is stretched when the connector 1 is mounted on the circuit board 3 so that it presses with a force F, pushing the connector away from the circuit board against the respective mating contact. The contact may also be designed as a solder pin or the like.

The busbar 40 is preferably made as a single piece of stamped and bent from a good conducting material. It extends through the connecting chamber 10 from a connecting side 131 of the housing part 11 to a contact side 141 of the housing part 11. The connecting side 131 and the contact side 141 are situated opposite each other. But the invention also applies to connectors 1 in which the connecting side 131 and the contact side 141 are situated at an angle to each other, especially at a right angle to each other and/or adjacent to each other.

At the connecting side 131, an electrical connecting member such as a conductor 2 can be electrically connected directly to the busbar 40. At a contact side 141, the busbar 40 can make electrical contact with a circuit board 3.

The busbar 40 includes a connecting arm 41 for connection with the electrical connecting member 2 as well as a contact arm 42 for connecting to the circuit board 3. The connecting arm 41 and contact arm 42 are joined together by a connection arm 43.

The connecting arm 41 extends in a connecting and mounting direction X. It lies at least partially flat against an inner wall 12 of the housing part 11. On the connecting arm 41 of the busbar 40 there is provided a holding device 411, which engages with a recess 121 of the inner wall 12. The holding device 411 is wave shaped. In this way, the holding device 411 can serve at the same time as an end stop for a clamping leg 61 of a clamping spring 6. Preferably, instead of a wavy, rounded shape of the holding device 411, a somewhat angular or zig zag shape of the holding device 411 can also be provided. The recess 121 is configured corresponding to the holding device 411, so that the holding device 411 fits into the recess 121.

At the connecting side 131, the connecting arm 41 arm is formed as a clamping contact 410 such as a push-in spring contact. A clamping spring 6 is provided which is secured by a holding leg 62 in the connecting chamber 10. The clamping spring 6 furthermore includes a clamping leg 61 which is designed for clamping the connecting member 2 in the connecting chamber 10. The clamping leg 61 and the holding leg 62 are joined together by a connection bow 63. The clamping spring 6 is made as a single piece of spring steel. When inserting the connecting member 2, the clamping leg 61 is pivoted into the connecting chamber 10 against a restoring force, until the connecting member 2 can slide between the busbar 4 and the clamping leg 61. The clamping leg 61 is then pivoted back with the restoring force and clamps the connecting member 2 against the busbar 4.

FIG. 1*b* shows an electrical conductor as a connecting member 2. But instead of an electrical conductor as the connecting member 2, a plug or an electrically conductive rod is also preferred. The electrical conductor 2 includes an electrically conductive core 21 and an electrically insulating casing 22. The insulation is stripped off at one end so that the casing 22 is removed and the core 21 is exposed. Connection of the electrical conductor 2 to the clamping contact 410 of the connector 1 is accomplished by introducing the stripped-offend of the conductor 2 in the connecting direction X between the busbar 40 and the clamping leg 61. The connecting direction X extends in a first direction of extension X of the connector 1.

The contact arm 42 is formed as a spring. In a connecting condition of the connector 1 to the circuit board 3 in which the connector 1 is placed on the circuit board 3 pressed against it and locked to it, the contact arm 42 is designed to press against the circuit board 3. The connecting direction X therefore extends in the connecting condition of the connector 1 to the circuit board 3, perpendicular to the latter.

In order to give the contact arm 42 a spring action, the connection arm 43 extends transversely to the connecting arm 41. Furthermore, the connection arm 43 has a bow. In this way, the connection arm 43 and the contact arm 42 are arranged in a U shape.

Therefore, when the contact arm 42 is placed on the circuit board 3, it can be pressed against the restoring force toward the connecting arm 41, so that its free end in the connecting condition is pressed with the restoring force against the circuit board 3. Next, the connector 1 can be fastened with one or more locking pins to the circuit board 3 so that the connector 1 can no longer be spontaneously released from its position.

The spring force of the contact arm should be dimensioned such that a very good contact is assured. The contact arm 42 has at its open end a contact lug 421 shaped as a bow and designed for contacting the circuit board 3. Owing to the bow shape, the contact surface 31 of the circuit board 3 is not damaged when the contact lug 421 is pressed against it.

The U-shaped assembly of the contact and connection arms 42, 43 results in a tilting moment on the connector 1, while tilting of the connector 1 is at first prevented by the locking of the connector 1 on the circuit board 3.

In order to equalize the tilting moment as much as possible and prevent tilting of the connector 1 from the outset, the busbar 40 can be positioned in two positions I, II in the connecting chamber 10 of the housing part 11. FIG. 1*a* shows the connector 1 with the busbar 4 arranged in the first position I, FIG. 1*b* shows the connector 1 with the busbar 4 arranged in the second position II, and FIG. 1*c* shows the busbar 40 in the first position I by solid lines and in the second position II in the connecting chamber 10 of the connector 1 by broken lines.

It can be seen that the busbar 40 in the first position I has been rotated by 180° relative to the second position II in a direction of rotation 55 about the connecting direction X. In this way, the contact arm 42 in the first position I extends against a second direction of extension 52 of the connector 1, which extends transversely to the first direction of extension of the connector 1, and therefore also transversely to the connecting direction X. In the second position II, the contact arm 42 arm extends in the second direction of extension of the connector 1. Therefore, in these two positions I, II, the tilting moment produced by the restoring force of the contact arm 42 when the connector 1 is pressed against the circuit board 3 acts in opposite directions.

By adjacent positioning of two or more such housing parts 11 in a third direction of extension, which is situated transversely to the first direction of extension 51 and transversely to the second direction of extension with busbars 4 which are arranged alternating in the first position I and in the second position II, a connector 1 can be produced for connecting two or more connecting members 2 to the circuit board 3 in which the tilting moments cancel out. Such a connector 1 will have no tendency to tilt given an even number of housings 11.

In order to fasten the housings 11 alongside each other, they are arranged in a top housing 15.

The present invention is also suitable for connectors 1 in which the contacts 4 for contacting the circuit board 3 are arranged directly in a housing which can include one or more chambers for receiving these contacts 4. The housing part 11 is then eliminated.

Furthermore, the invention is also suitable for a connector 1 in which only a single contact 4 is provided for contact with the circuit board 3. This may either be inserted directly into a housing which is fastened to the circuit board 3 or it may be inserted into a housing 1 in the manner of FIG. 1*a*, for example which is inserted into a top housing 15 as shown in FIGS. 4*a* and 4*b*.

The terms housing and top housing are synonymous and are used with the reference number 15. To the extent that a contact 4 and a mating contact are mentioned in the following, this also applies to a plurality of contacts 4 and mating contacts 31.

The housing 15 is fastened by one or more locking pin assemblies 5 to the circuit board 3. To the extent that a locking pin assembly 5 is mentioned in the following, this includes a plurality of locking pin assemblies 5.

When the connector 1 is mounted on the circuit board and the contact 4 makes contact with the mating contact 31 of the circuit board 3, the locking pin assembly 5 passes through a corresponding opening or through hole 32 of the circuit board 3 and protrudes from the opening 32 on the side of the circuit board 3 facing away from the housing 15. The locking assembly is radially expanded to an extent that it secures the housing 15 and thus the connector 1 to the circuit board 3.

The locking pin assembly 5 has a plurality of functional elements which are movable relative to each other.

In the most simple configuration, the locking pin assembly includes two elements which are movable relative to each other. But it may also include more than two elements which are movable relative to each other.

These elements preferably include preferably an expanding mandrel 50, one or more expanding elements or wedges 51 preferably arranged concentrically relative to the expanding mandrel 50 and one or more expanding webs 52 arranged concentrically relative to the expanding wedges 51.

The centrally arranged expanding mandrel 50 may have a round or an angular construction, and a polygonal configuration.

The expanding mandrel 50 may has a constant cross section along its length in the direction X or the cross section may vary along the length in direction X.

One or more of the expanding wedges 51 are concentrically arranged around the circumference of the mandrel. Around the circumference of the expanding wedges and concentric to the expanding wedge assembly are a plurality of the expanding webs 52. In a polygonal construction, one of the expanding wedges 51 is arranged on the outside of each side of the polygon on the lines of an imaginary polygon. The expanding webs 52 are arranged on the outside of the wedges on the lines of another imaginary polygon as shown in FIGS. 9*a*-9*c*. Polygonal assemblies in the manner of FIGS. 9*b* and 9*c* are also considered to be concentric assemblies according to the invention.

The expanding webs 52 preferably have a constant cross section along their length although this is not mandatory. The cross section of the expanding wedges 51 varies for a portion in the direction X.

In a locking state, the overall diameter of the locking pin assembly formed from the elements 50, 51, 52 must be larger than the diameter of the opening 32 of the circuit board 3 so that self-locking of the housing 15 to the circuit board 3 is accomplished which also absorbs the contact forces in the manner of an abutment.

It is also possible to interchange the radial assembly or sequential order of the expanding wedge 51 and expanding web 52 elements.

The expanding wedges 51 are formed on the housing 15. The expanding wedges 51 are moved together with the housing 15. It is advantageous for the expanding mandrel 50 and the expanding webs 52 to be movable relative to the expanding wedges 51.

The expanding mandrel 50 and the expanding webs 52—i.e., the innermost of the concentric layers and preferably the outermost of the concentric layers—are preferably formed on an actuation device 500 which is movable relative to the housing 15. The housing 15 and the actuation device 500 are designed to be displaceable relative to each other. The actuation device 500 forms a slide and the actuation device 500 and the housing 15 include corresponding guiding elements such as pins 55 and elongated holes 56 which allow sliding of the actuation device 500 on the housing 15 in a locking direction X and in an opposite releasing direction −X. Furthermore, the actuation device 500 may also be guided in a groove of the housing.

Attachment of the connector to a circuit board 3 shall be described more closely with to FIGS. 2 to 6.

Figure 2:
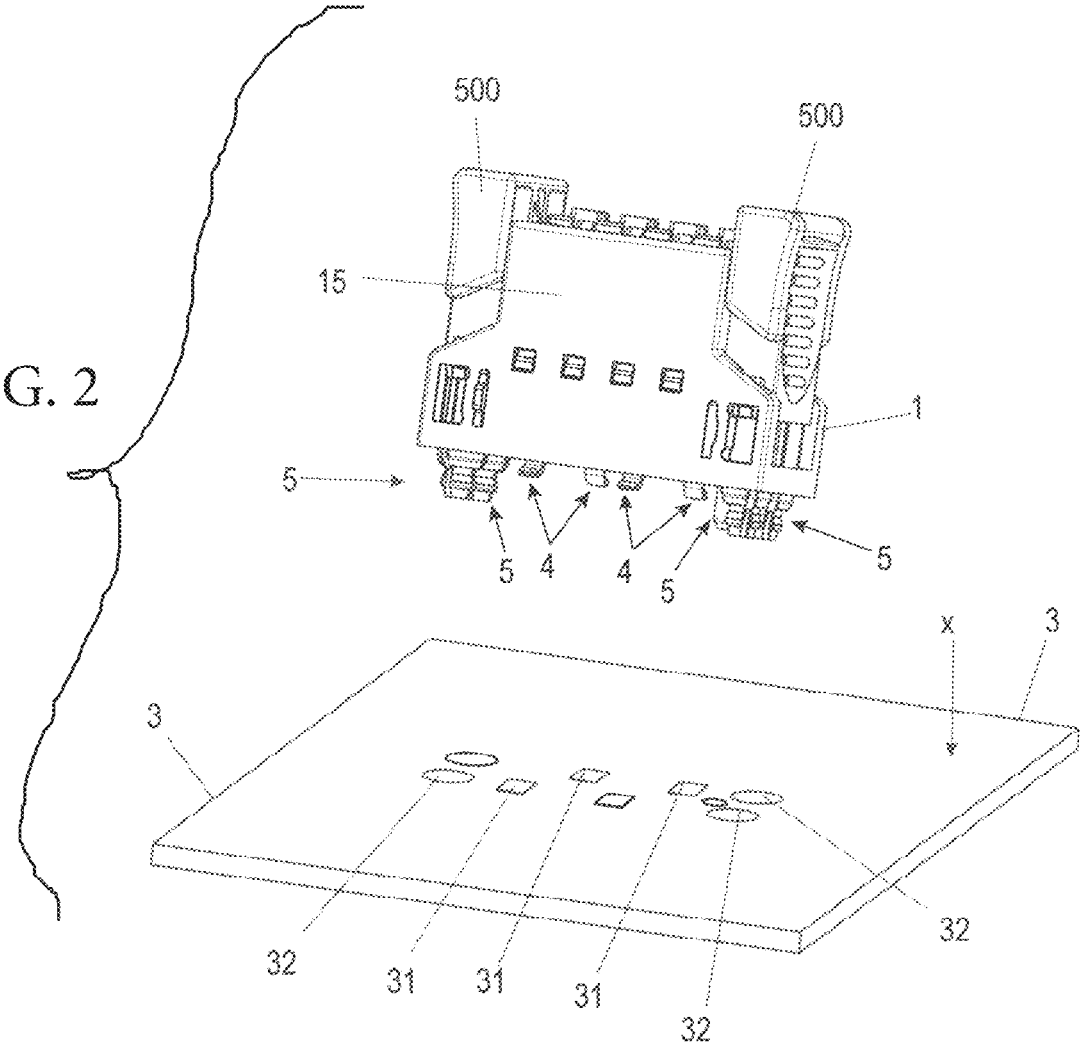
FIGS. 2 and 3 are exploded and perspective views, respectively, before and after attachment of the electrical connector to an electrical circuit board.
Figure 3:
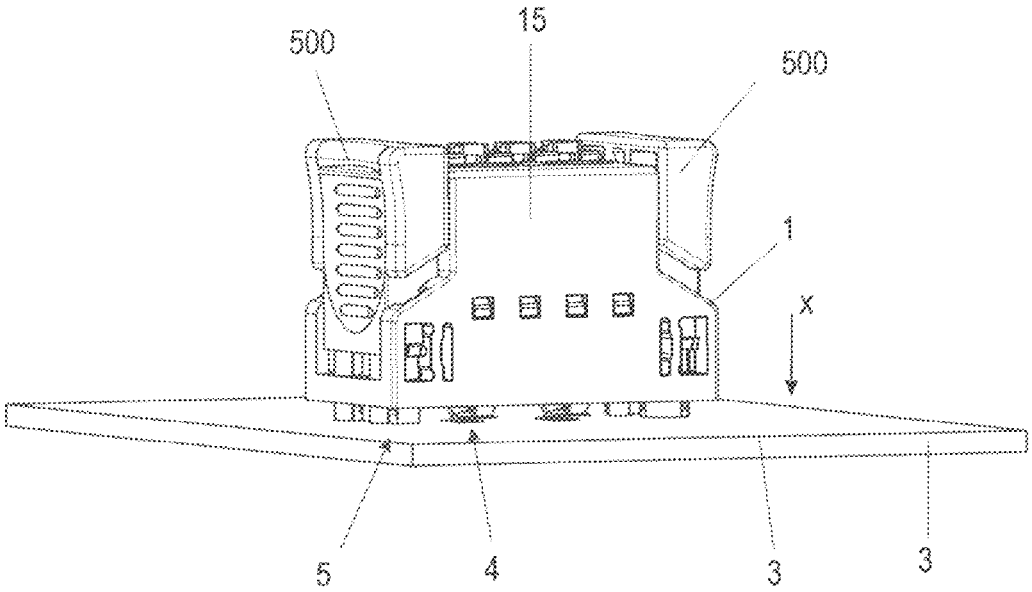

When the connector 1 is placed in a mounting direction X on the circuit board 3 and directed perpendicular or substantially perpendicular to the circuit board 3 as shown in FIG. 2, the contacts 4, which are compression spring contacts, are initially compressed as shown in FIG. 3. In the force/distance diagram of FIG. 6, this is indicated by the line 1 for mounting of the connector and line 2 for compression of the contacts 4. Preferably the housing 15 of the connector 1 is mounted on the circuit board 3 as shown in FIG. 4.

During mounting of the connector 1, the actuation device 500 is initially in an upper position into which it was previously moved upward on the housing 15 and against the displacement direction X.

The expanding wedges 51 which are preferably integrally formed on the housing 15, are introduced during mounting of the connector 1 on the circuit board 3 into the openings 32 of the circuit board 3 and protrude from the openings 32 on the side of the circuit board 3 facing away from the housing 15 after complete mounting of the housing 15. Preferably, the diameter of the imaginary polygon or circle on which the wedges are situated is less than the maximum diameter of the opening 32 of the circuit board 3 so that no force is required to lead the expanding wedges 51 through the respective opening 32. The expanding webs 52, which are formed as a single piece on the actuation device 500, can be directed into the opening 32 which facilitates further activation. The expanding mandrel 50 lies in the middle between the upper ends of the expanding wedges 51 but preferably does not yet protrude into the opening 32.

Starting from the position shown in FIG. 4, the actuation device 500 is now activated which means that it is displaced on the housing 15 in the mounting direction and placement direction X relative to the housing 15. An actuation surface 501 is formed on the actuation device 500. The surface is preferably knurled.

The expanding wedges 51 have a thickened portion 511 extending for at least a portion perpendicular to the displacement direction as shown in FIG. 5*b*. This may be formed as a bevel on which the expanding webs 52 when lowered are guided by the actuation device and after emerging from the opening 32 and spread radially apart at an angle.

During movement of the actuation device 500 from an upper position to a lower position in terms of the position of the circuit board 3 relative to the housing 15, the expanding mandrel 50 and the expanding webs 52 also move in the mounting direction X. The expanding mandrel 50 is moved inwardly toward the expanding wedges 51 and the expanding webs 52 are moved outwardly toward the expanding wedges 51. The expanding mandrel 50 and the expanding webs 52 are dimensioned such that they slide past the thickened portion 511 of the expanding wedges 51. In this region, the total cumulative radial extension or the total diameter of the expanding locking pin assembly 5 formed from the expanding mandrel 50, the radius of the imaginary circle or the imaginary polygon of the expanding wedges 51 and the radius of the imaginary circle or the imaginary polygon of the expanding webs 52 is larger in the circumferential direction, preferably more than 10% larger, than the diameter of the opening 32 of the circuit board. The expanding mandrel 50 is braced on the inner side against the expanding wedges 51. In this way, the expanding webs 52 slide on the expanding wedges 51 and are forced overall into an expanded position to the final position shown in FIG. 5.

One, or preferably two, or more expanding wedges 51 are provided or distributed around the circumference of the respective expanding mandrel 50.

Similarly, one, or preferably two, or more expanding webs 52 are provided or distributed around the respective expanding mandrel 50. In their interplay, the expanding webs 52 act as an expanding rivet.

Figure 6:
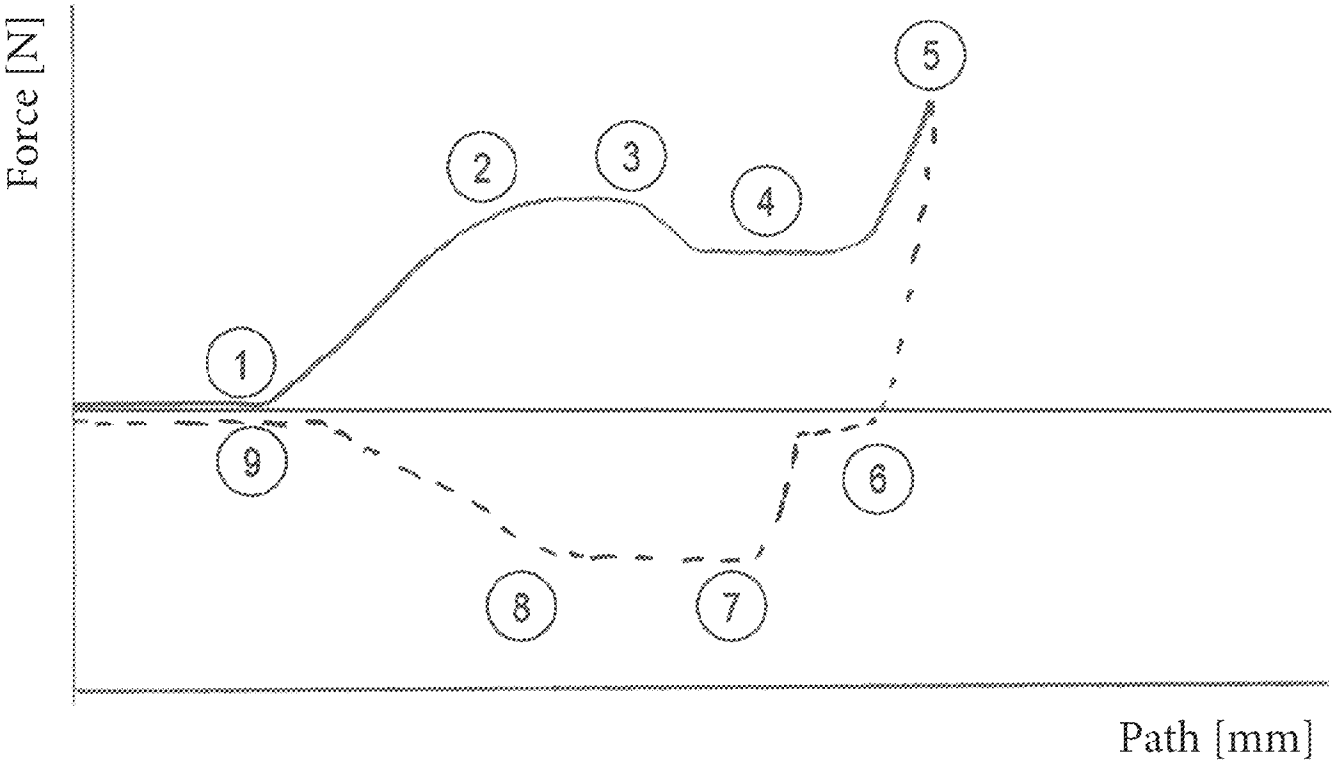
FIG. 6 is a diagram showing force variations as a function of the activation path of an actuation slide device during mounting, locking and unlocking, and removal of a connector relative to a circuit board.

In the force/distance diagram of FIG. 6, it is shown that after (line 2), at first a slight break away of the actuation device 500 must occur before it can be moved with slight force from the upper position shown in FIGS. 4*a* and 4*b* to the lower position as shown in FIGS. 5*a* and 5*b* and line 4 in FIG. 6. Only upon expanding into the final locking position of FIG. 5 is a somewhat larger force required in order to obtain expansion of the expanding webs 52 on the expanding wedges 51 as shown by line 5. It is advantageous for the compression spring contacts to be compressed initially and for actual locking to occur only after compression of the contacts 4 so that smooth and easy operation by the user is possible. In this process, the locking webs 52 are not deformed to the extent that release becomes impossible. Instead, it is possible to release or unlock the webs and make repeated use of the connector 1.

The locking pin assembly 5 has been moved into a locking position which is designed so that the housing 15 in the region of this locking device cannot be removed from the circuit board 3 without the actuation device 500 being moved on the housing 15 once again from the lower locking position to the upper release position.

In a subsequent release of the connector 1, the broken-line portion of the force/distance diagram comes into play. At first, the actuation device 500 is moved back from the lower to the upper position. The expanding webs 52 and the expanding mandrel are likewise moved back into the upper position, which releases the lock (line 7 of FIG. 6), before the force of the compression springs of the contacts is overcome (line 8) at which time the connector 1 can once again be removed from the circuit board 3.

It is also possible to provide more than one interaction with the housing 15. In this way, multiple locking can be achieved by the movement of a single actuation device 500. This is possible because an optimized locking assembly has been developed in which the force/distance curves have been optimized so that twofold or multiple locking can be performed on a single actuation device 500 even with manual operation.

On the one hand, it is possible to provide on a connector housing 15 a single actuation device 500 with one more locking pin assemblies. Such solutions are shown in FIGS. 7 and 8. In FIG. 8, the one actuation device 500 having one or more locking pin assemblies 5 is situated on the housing 15 alongside a single contact 4.

In FIG. 7 on the contrary, the single actuation device 500 with one or more locking pin assemblies is arranged in a row between the contacts 4. This accomplishes a kind of intermediate locking.

It is also possible to provide two or more of the actuation devices 500 on a single connector housing, each with one or more locking pin assemblies 5. Such solutions are shown in FIGS. 2 to 5 and FIGS. 10 to 14. Each of the actuation devices 500 with one or more locking pin assemblies 5 can be arranged at two ends of the housing 15. This assures secure locking and easy handling during the contacting and locking process, and during release of the connector 1.

The embodiment of FIGS. 10 to 14 corresponds largely in terms of construction and operation of the embodiment of FIGS. 2 to 5.

However, the following differences exist in regard to the construction of the actuation device 500 and the locking pin assembly 5.

In FIG. 5, the actuation device 500 has a two-piece construction and includes a first activation section 501 and a second activation section 502. On the first activation section 501 are formed the expanding webs 52 and on the second activation section 502 is formed the expanding mandrel 50.

The first actuation section 501 is displaceable relative to the second activation section 502. Furthermore, the two actuation sections 501, 502 are displaceable relative to the housing 15 and displaceable on it.

During placement of the connector 1 on the circuit board 3, the two actuation devices 500 and their sections 501, 501 are at first located in their upper positions. But it is possible to initially activate the first activation section 501 and subsequently the second activation section 502.

Figure 10:
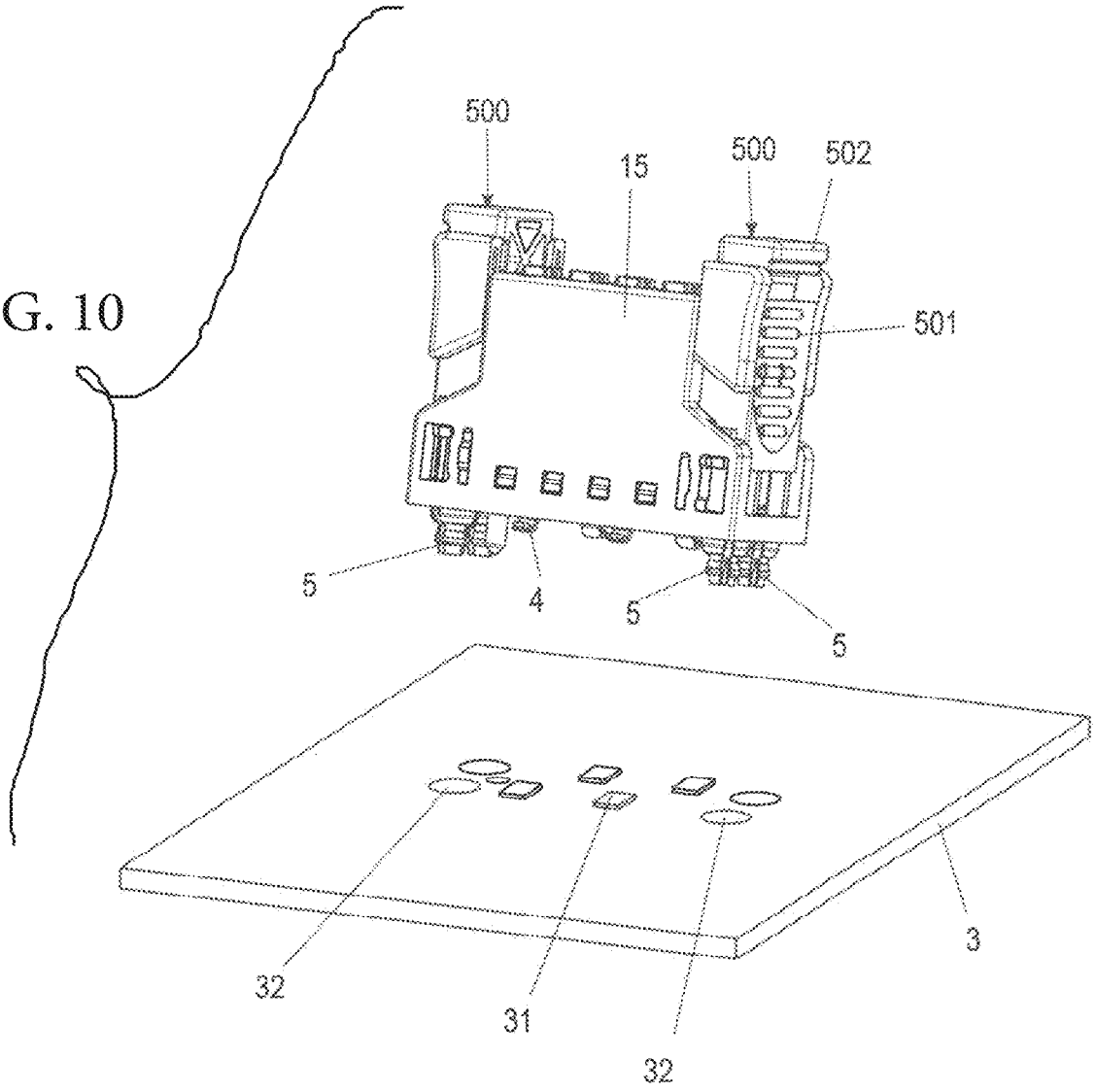
FIGS. 10 and 11 are perspective views of consecutive steps during mounting of the electrical connector on an electrical circuit board.
Figure 11:
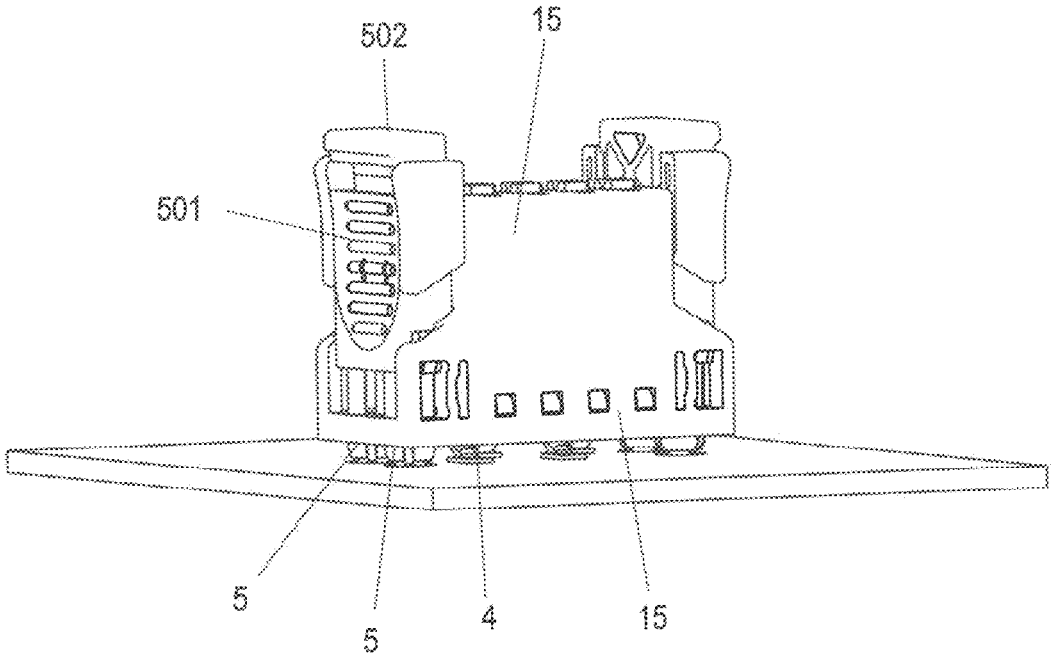

Mounting of the connector 1 in FIGS. 10, 11 and 12 initially occurs similar to that the mounting of FIGS. 2 and 3. In this position, the expanding webs 52 protrude into the opening 32 of the circuit board 3.

Next, the first activation section 501 with the expanding webs 52 is initially moved downwardly so that the expanding webs 52 slide along the outside of the expanding wedges 51. But since these can bend radially inwardly, no major force is required. Only then is the second activation section 502 pushed down from above in order to force the expanding mandrel 50 between the expanding wedges 51. In this way, the expanding wedges 51 move outwardly and thus so do the expanding webs 52 so that the locking position of FIG. 14 is achieved. This enhanced locking is easily performed by the user.

The housing 15 and the single or multiple-piece actuation device 500 are preferably made from a plastic material.

The invention claimed is:

1. An electrical connector (1) for connecting one or more conductors to a circuit board, comprising a) a housing which can be electrically connected on a connecting side of the electrical connector to an electrical connecting member, said housing including on a contact side of the electrical connector at least one contact to make electrical contact with at least one mating contact of the circuit board;

b) at least one locking pin assembly which when mounted on the circuit board passes through an opening of the circuit board and moves from a retracted release position to an expanded locking position in which its diameter on the side of the opening facing away from the housing is larger than the diameter of the opening of the circuit board;

c) at least one activating device arranged on said housing for movement relative to said housing; and d) said locking pin assembly including at least two functional elements movable relative to each other, one of said functional elements being arranged on said activating device and another of said functional elements being arranged on a component of the connector which is movable relative to the activating device.

2. An electrical connector as defined in claim 1, wherein said another of said functional element is arranged on one of said housing as the movable component of the connector relative to said activating device or on a further activating element.

3. An electrical connector as defined in claim 1, wherein said contact comprises a compression spring contact.

4. An electrical connector as defined in claim 1, wherein the mating contact is arranged on a surface of the circuit board.

5. An electrical connector as defined in claim 1, wherein said housing and a respective activating device each form at least two of said locking pin assemblies.

6. An electrical connector as defined in claim 1, wherein said functional elements of each locking pin assembly comprise at least one expanding mandrel, at least one expanding wedge, and at least one expanding web.

7. An electrical connector as defined in claim 6, wherein a plurality of expanding wedges are arranged radially and concentrically relative to said expanding mandrel and a plurality of expanding webs are arranged radially and concentrically relative to said expanding wedges.

8. An electrical connector as defined in claim 7, wherein said expanding mandrel and said expanding webs are arranged on said activating device and said expanding wedges are arranged on said housing.

9. An electrical connector as defined in claim 1, wherein said activating device has a single or multiple piece configuration.

10. An electrical connector as defined in claim 6, wherein said expanding web and said expanding mandrel move synchronously with said activating device.

11. An electrical connector as defined in claim 10, wherein said activating device includes a first activation section on which said at least one expanding web is formed, and a second activation section which is displaceable relative to the first activation section and on which said expanding mandrel is formed.

12. An electrical connector as defined in claim 6, wherein said at least one expanding wedge has a thickened region which is arranged on a side of the circuit board facing away from said housing when the connector is mounted on the circuit board and on which said at least one expanding web is moved into the expanded locking position during locking.

13. An electrical connector as defined in claim 6, wherein said expanding mandrel has one of a round, angular, and polygonal cross section, a plurality of said expanding wedges being arranged around a circumference of said expanding mandrel and a plurality of said expanding webs are arranged around said expanding wedges.

14. An electrical connector as defined in claim 9, wherein said activating device comprises a sliding device and said activating device and said housing include guides which enable displacement of said activating device on said housing in opposed locking and release directions.

15. An electrical connector as defined in claim 12, wherein when said activating device is moved into an upper position remote from the circuit board and the connector is mounted on the circuit board, a plurality of said expanding wedges pass through respective opening of the circuit board and said expanding mandrel and a plurality of said expanding webs have not yet passed through the opening, said activating device being movable from the upper position into a lower position in which said expanding mandrel engages between said expanding wedges as far as said thickened region of said expanding wedges and in which said expanding webs are moved into an interacting expanded locking position.

16. An electrical connector as defined in claim 1, wherein a plurality of said activating devices are provided on said housing.

17. An electrical connector as defined in claim 16, wherein at least one of said activating devices is provided on said housing between said contacts.

18. An electrical connector as defined in claim 1, wherein two of said activating devices are arranged on said housing on opposite sides of said contacts.

19. An electrical connector as defined in claim 1, wherein said contact comprises one of a pin, knife, and socket contact.

20. A method for contacting a circuit board with a connector as defined in claim 1, comprising the steps of a) placing the connector on the circuit board, said contacts of the connector contacting the mating contacts of the circuit board and said expanding wedges passing through an opening of the circuit board;

b) moving said at least one activating device into a locking position on the housing by applying a locking force to move said expanding webs into their expanded locking position arranged exteriorly of said expanding wedges which are arranged interiorly of said expanding webs and against said expanding mandrel.

21. A method as defined in claim 20, wherein said expanding mandrel and said expanding webs are synchronously moved into the locking position.

22. A method as defined in claim 21, wherein two activating sections are displaced in succession on said housing and said expanding mandrel and said expanding webs are moved in succession into the locking position.

* * * * *